US008622753B2

(12) United States Patent
Balzano

(10) Patent No.: US 8,622,753 B2
(45) Date of Patent: Jan. 7, 2014

(54) PIN CONNECTOR ASSEMBLY

(75) Inventor: Alfiero Balzano, Garden Grove, CA (US)

(73) Assignee: Basic Electronics, Inc., Garden Grove, CA (US)

( * ) Notice: Subject to any disclaimer, the term of this patent is extended or adjusted under 35 U.S.C. 154(b) by 461 days.

(21) Appl. No.: 12/964,652

(22) Filed: Dec. 9, 2010

(65) Prior Publication Data

US 2012/0149232 A1 Jun. 14, 2012

(51) Int. Cl.
*H01R 12/00* (2006.01)

(52) U.S. Cl.
USPC ..... 439/67; 439/225

(58) Field of Classification Search
None
See application file for complete search history.

(56) References Cited

U.S. PATENT DOCUMENTS 2,946,877 A * 7/1960 Nalette et al. ..... 200/292
3,701,964 A * 10/1972 Cronin ..... 439/45
3,951,497 A 4/1976 Balzano et al.
4,526,432 A * 7/1985 Cronin et al. ..... 439/320
4,802,866 A 2/1989 Balzano et al.
4,808,112 A * 2/1989 Wood et al. ..... 439/66
4,948,951 A 8/1990 Balzano
5,194,010 A * 3/1993 Dambach et al. ..... 439/79
5,565,124 A 10/1996 Balzano
5,600,115 A 2/1997 Balzano
5,691,509 A 11/1997 Balzano
6,232,552 B1 5/2001 Balzano
6,257,329 B1 7/2001 Balzano
6,347,915 B1 2/2002 Balzano
6,488,532 B2 12/2002 Balzano
6,537,082 B2 * 3/2003 Hopfer et al. ..... 439/67
6,739,878 B1 5/2004 Balzano
7,364,440 B2 * 4/2008 Gobron et al. ..... 439/77

* cited by examiner

*Primary Examiner* — Michael Zarroli
(74) *Attorney, Agent, or Firm* — Stetina Brunda Garred & Brucker

(57) ABSTRACT

A connector assembly is provided for communicating electrical signals between a connector having a plurality of pins and a remote location. The assembly comprises a mounting board mountable on the pins and having a plurality of apertures for receiving and retaining the pins. The mounting board further includes a plurality of conductive patterns formed thereon, each conductive pattern extending from one of the pin apertures to an associated connector pad formed on the mounting board. A flexible cable having a plurality of conductors and connector pads is disposed adjacent the mounting board such that the cable connector pads are arrayed proximate the mounting board connector pads, in vertical registry therewith. A retaining member is connected to the mounting board for urging the flexible cable connector pads into electrical communication with the mounting board connector pads.

14 Claims, 7 Drawing Sheets

PIN CONNECTOR ASSEMBLY

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to connector assemblies and, more particularly, to a connector assembly for interfacing pin connectors to multi-connector flexible cables.

Electrical systems commonly include various circuits and assemblies that interconnect that form the overall system. Components of this system may be manufactured by different companies, or otherwise constructed in a modular form such that the different components may be removed, replaced or upgraded without the need to disassemble the whole system. Multi-connector cables are commonly used to communicate electrical signals, including power signals, information signals, clock signals, etc. between modules, and between electrical systems. In some cases the cables may have pin connectors affixed to one or both ends which engage mating connectors on another component. Such connectors may be mated to conventional cables by means of a corresponding female connector. However, repeated engagement and disengagement of such male and female pin connectors can cause pin damage, or otherwise bend the connectors such that connectivity may be jeopardized with the connector is exposed to vibrations or other severe environmental conditions, such as may occur in aerospace applications or the like.

Faced with such problems, some producers have chosen to connect the individual pin conductors to conductive traces formed on the circuit board, which in turn are soldered to individual connectors of a multi-connector cable. This is a tedious process, though the end result may be a reliable connection. Moreover, soldering is an undesirable process, requiring tin/lead solder, flux and cleaning solutions, all of which can contain materials hazardous to operators and the environment, while creating more costs for management, making control of the processes more difficult, and requiring the proper treatment and disposal of hazardous materials.

In use, the cables may themselves fail over time and need to be replaced. In other cases, the integrity of the cable may simply be uncertain, and replacement of the cable may be a troubleshooting option that is preferable to replacing a complex and expensive circuitry component. However, the soldered connections between the cable and the circuit board make that option more difficult and tedious.

Accordingly, it is desirable to provide a connector assembly wherein the connecting cable can be in reliable electrical communication with the pin connectors, yet disconnectable and replaceable without the need to perform soldering or desoldering functions.

Further, it is preferable that such connector assembly allows the connecting cable to be readily replaceable as useful for maintenance demands, as trouble shooting requires, or as system modifications evolve to utilize different types of connective patterns.

Preferably such a connector should also be able to withstand vibrations and other environmental conditions that might otherwise degrade connector performance over time.

BRIEF SUMMARY

A connector assembly is provided for communicating electrical signals between a connector having a plurality of pins and a remote location. The assembly comprises a mounting board mountable on the pins and having a plurality of apertures for receiving and retaining the pins. The mounting board further includes a plurality of conductive patterns formed thereon, each conductive pattern extending from one of the pin apertures to an associated connector pad formed on the mounting board. A flexible cable having a plurality of conductors and connector pads is disposed adjacent the mounting board such that the cable connector pads are arrayed proximate the mounting board connector pads, in vertical registry therewith. A retaining member is connected to the mounting board for urging the flexible cable connector pads into electrical communication with the mounting board connector pads.

The mounting board connector pads are preferably arrayed along a peripheral portion of the board.

The retaining member may be formed to define a retaining ring connectible to the mounting board, and a resilient member disposed intermediate the ring member and the mounting board, for resiliently urging the flexible cable connector pads into electrical communication with the mounting board connector pads.

Alternately, the retaining member may define at least one retaining bar engaging to the mounting board, with a resilient member disposed intermediate the retaining bar and the mounting board.

In the presently preferred embodiment each of the connector pins is associated with a dedicated conductive pattern, a dedicated mounting board conductor pad, and a dedicated flexible cable connector pad. The flexible cable conductor defines a plurality of exposed connector pads contact areas.

In one embodiment the mounting board is formed as a circular disk which is in substantial vertical registry with the retaining ring. In another embodiment the mounting board is formed to be substantially D-shaped, defining a circular periphery portion and a straight periphery portion, the mounting board connector pads being arrayed along the straight periphery portion.

The retaining member/retaining board/retaining ring, preferably define a plurality of receiving apertures, disposed in substantial vertical registry with corresponding apertures formed in the mounting board and formed in the flexible cable, to ensure that the mounting board connector pads and the flexible cable connector pads are arrayed in substantial vertical registry, and firmly retained in place.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The various features of the embodiments disclosed herein are intended to be exemplary in nature, and can be used alone, or in varying combinations with each other. As such, the present invention is not intended to be limited to the specific combination described herein. Thus, the scope of the claims is not to be limited by the illustrated embodiments.

Figure 1:
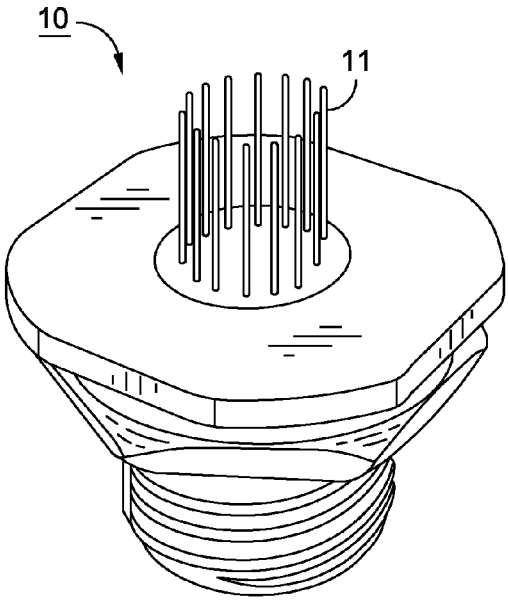
FIG. 1 (PRIOR ART)
FIG. 1 illustrates a conventional prior art pin connector.

Referring to the drawings, FIG. 1 illustrate a conventional prior art pin connector 10, having a plurality of pins 11. As noted above, such plug in connectors are unsuitable for some applications, such as where vibration requirements are more demanding, where the circuitry simply does not practically or reliably allow for a mating connector plug, or where repeated insertion and removal of the plug connector threatens to result in bent or broken contacts that may be difficult to detect or remedy.

Figure 2:
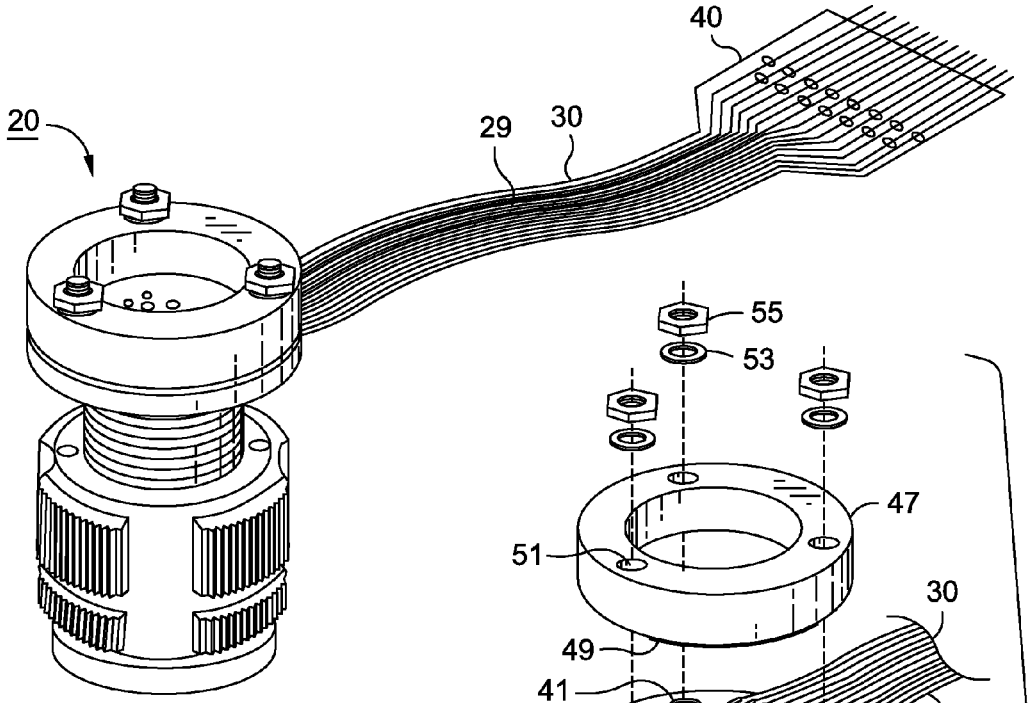
FIG. 2 is a perspective view of one embodiment of a connector assembly in accordance with the present invention, engaged to a flexible cable.

FIG. 2 illustrates a prospective view of one embodiment of a connector assembly in accordance with the present invention. The connector assembly 20 is shown in exploded view in FIG. 3. Various components of the connector assembly 20 are shown at FIGS. 4-7.

The connector assembly 20 includes a connector base 21, which terminates in a plurality of connector pins 23. The connector pins extend into or through pin apertures 28 formed in rigid mounting board 25, to communicate with traces 27. The traces 27 extend from the pin apertures 28 to connector pads 31 formed on a periphery portion of mounting board 25. Each of the mounting board connector pads 31 may define a raised contact area. In the illustrated embodiment, the mounting board 25 is formed as a circular disc.

Flexible cable 30 extends from the connector assembly 20, e.g. to a remote connector adapted to receive and engage flexible cable connector 40. A flexible cable 30 is formed of a plurality of individual conductors 29 extending therethrough, which terminate in flexible cable connector pads 39 (shown at FIG. 5). As with the mounting board connector pads, the flexible cable connector pads may include raised contact areas, which may define a flat raised surface or complementary shaped surfaces. Examples of such a flexible cable and mating substrate, with complementary connector pads, are disclosed in U.S. Pat. No. 5,691,509 to Balzano and U.S. Pat. No. 6,739,878, also to Balzano, the contents of which are incorporated herein by reference.

The cable connector pads 39 are disposed adjacent the mounting board connector pads 31, to facilitate electrical communication therebetween. The flexible cable 30 may define an insulating ring 42 which supports the exposed flexible cable connector pads 39, and extends about the upper surface of the mounting board 25. The ring 42 may incorporate a plurality of apertures 41 positioned to receive and engage stems or pins 43, to orient the ring 42 and flexible cable connector pads 39 in registry with the mounting board connector pads 31. Resilient members 45, which may be formed as elastomeric pads, are arrayed on the upper surface the upper surface of mounting board 25 to allow resilient compression of the insulating ring 42 between the mounting board 25 and the retraining member 47.

Retaining member 47 may be formed as a retaining ring having a plurality of apertures 51 to similarly receive and engage screws 43. Resilient members 49, which may be formed as elastomeric pads, are arrayed on the lower surface of the retaining ring 51 to resiliently compress the insulating ring 42 and flexible cable connector pads 39 in electrical engagement with the mounting board connector pads 31, when tightened in place by engaging washers 53 and nuts 55 to screws 43. Alternately, the retaining member itself may be formed to have suitable resilient properties to resiliently urge the flexible cable pads 29 into reliable electrical communication with mounting board connector pads 31.

Figure 3:
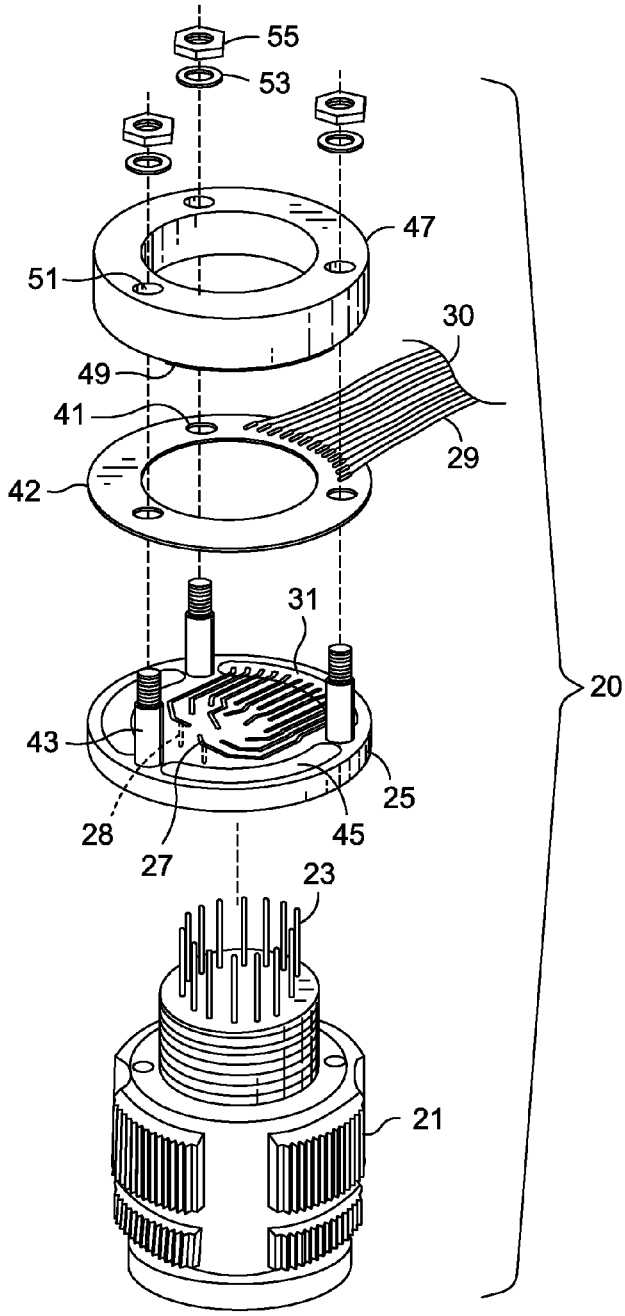
FIG. 3 is an exploded view of the assembly shown in FIG. 2.
Figure 4:
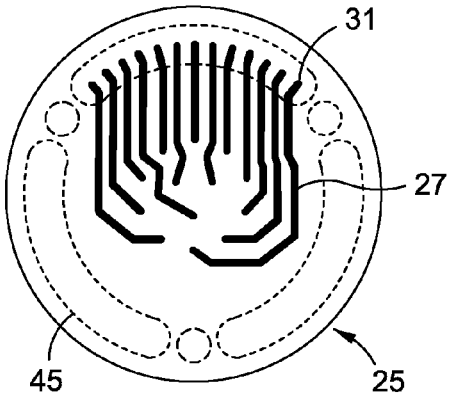
FIG. 4 is a top view of the mounting board shown at FIG. 3.

FIG. 4 illustrates a top view of the mounting board 25, shown at FIG. 3. The mounting board 25 includes a plurality of traces 27, extending from pin apertures 28 to connector pads 31. As described above, the mounting board connector pads 31 are in electrical communication with the flexible cable connector pads 39, when compressed by the retaining member 51, formed as a flexible bar. As a result, reliable electrical communication is established between the connector pins 11 and the flexible cable conductors 29, which can withstand substantial and repeated vibration and other demanding environmental conditions. Moreover, when trouble shooting or repair requires, the flexible cable 30 can be readily removed and replaced, without the need to engage or disengage pin connectors, and without the need to solder or de-solder the flexible conductors 29 to the pins or to the conductive traces extending from the pins.

In the presently preferred embodiment, each of the pins 11 is connected to a dedicated trace 27, a dedicated mounting board connector pad 31, a dedicated flexible cable connector pad 39 and a dedicated flexible cable conductor 29. However, it is to be understood that in certain cases signals may not be present on individual of the connector pins, or if present, may not need to be communicated to the remote location, depending upon a particular application. In other cases, signals on a pin may be communicated (jumped) to a plurality of the flexible cable conductors, where the same signal is intended to be communicated to multiple circuits. As such, the particular pattern for connecting the pins to the cable connectors, or for jumping signals from one cable connector to a plurality of cable connectors, is understood to be a matter of design preference, depending upon the needs of a particular application.

Figure 5:
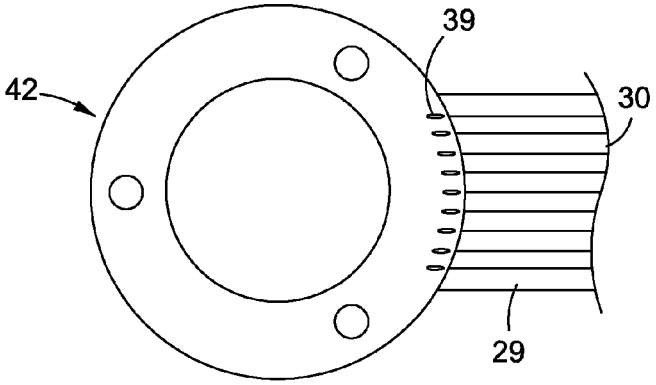
FIG. 5 is a bottom view of the insulating ring shown at FIG. 3.
Figure 6:
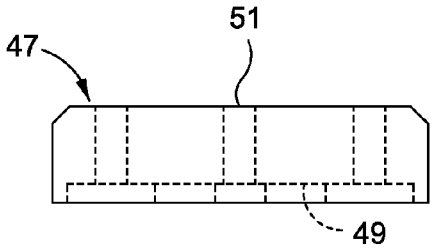
FIG. 6 is a side view of the retaining member shown at FIG. 3.
Figure 7:
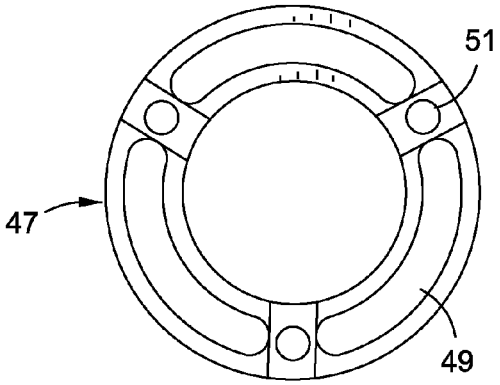
FIG. 7 is a bottom view of the retaining member shown at FIG. 3.
Figure 8:
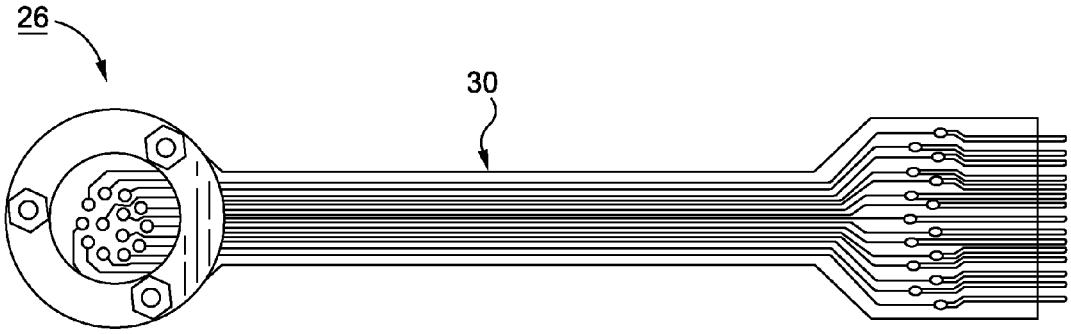
FIG. 8 is a top view of the connector assembly engaged to a flat, flexible cable.
Figure 9:
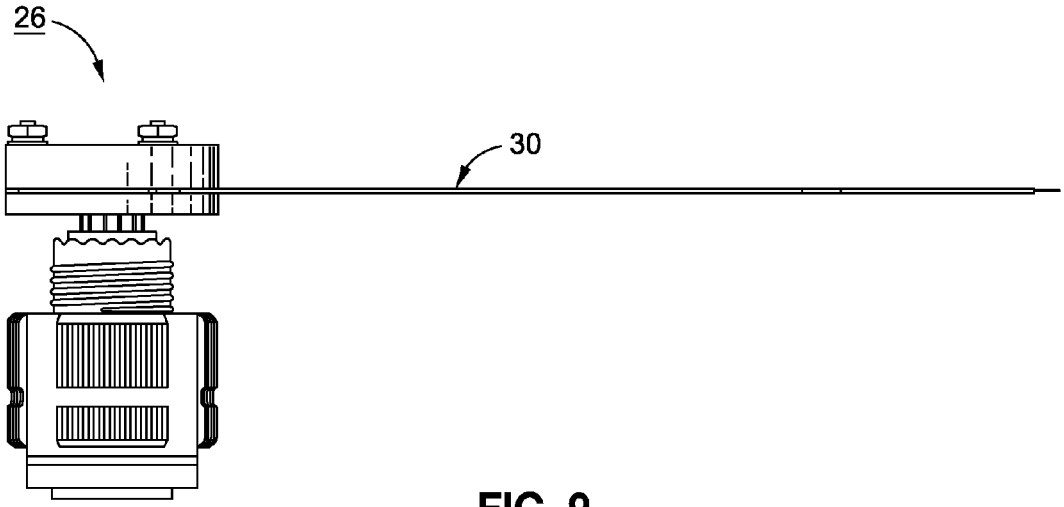
FIG. 9 is a side view of the connector assembly engaged to the flexible cable.
Figure 10:
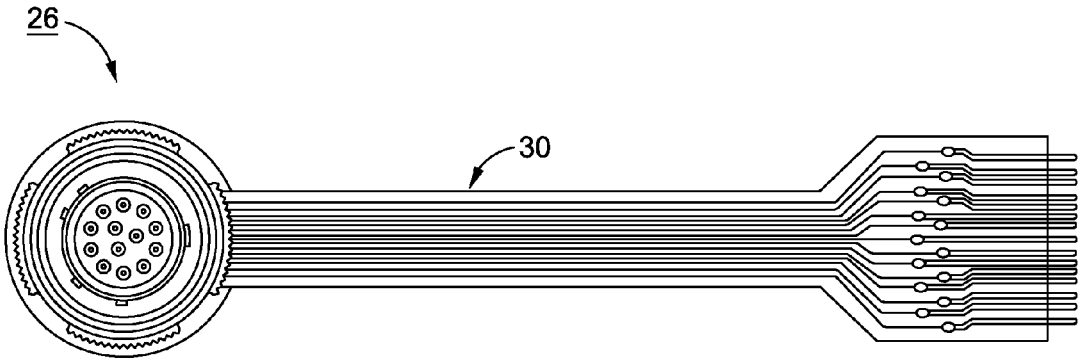
FIG. 10 is a bottom view of the connector assembly engaged to the flexible cable.

FIG. 5 provides a bottom view of the insulating ring 42 shown at FIG. 3. FIG. 6 provides a side view of the same retaining member, illustrating the retaining ring apertures 51 and the resilient member 49. FIG. 7 provides a bottom view of the retaining ring 47, further illustrating the apertures 51 and the resilient members 49. FIGS. 8, 9 and 10 provide additional views of the assembly 20, engaged to the flexible cable 30.

Figure 11:
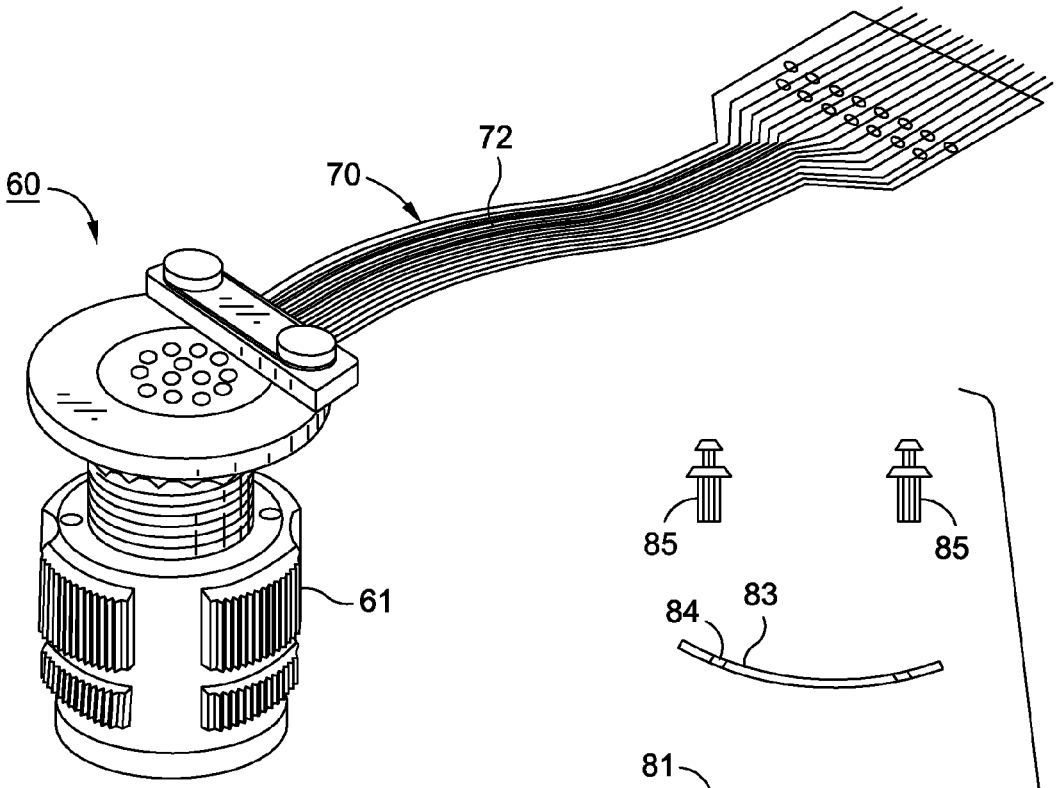
FIG. 11 illustrates an alternate embodiment of a connector assembly in accordance with the present invention, engaged to a flexible cable.
Figure 13:
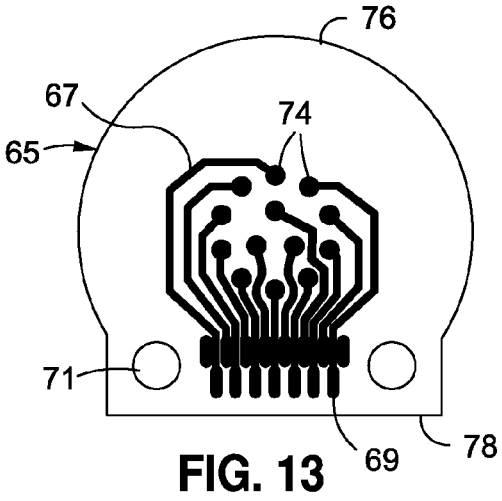
FIG. 13 is a top view of the mounting board shown at FIGS. 11 and 12.
Figure 12:
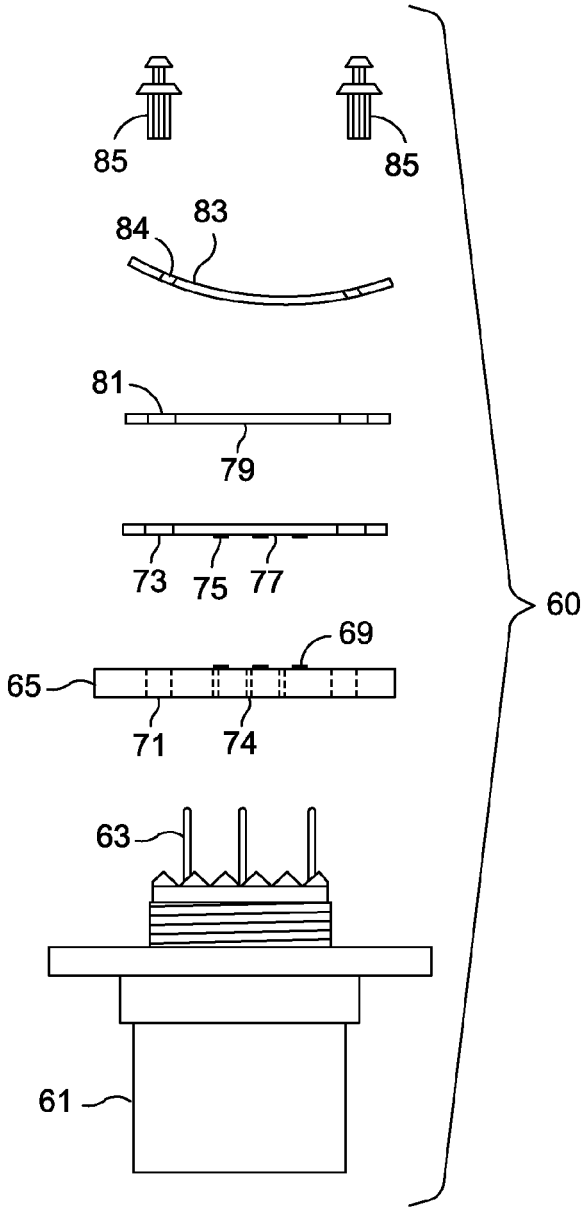
FIG. 12 is an exploded view of the connector assembly shown at FIG. 11.

FIG. 11 illustrates an alternate embodiment of a connector assembly 60 in accordance with the present invention, as engaged to a flexible cable. An exploded view of the assembly 60 is shown at FIG. 12, and a more detailed view of the mounting board 65 is shown at FIG. 13. The flexible cable assembly 60 provides an alternate construction of the retaining member for interfacing the mounting board 65 to a flexible cable 70. The pin assembly includes a connector base 61 having pins 63 extending therefrom. The mounting board 65 includes a plurality of pin apertures 74 for receiving pins 63.

As shown at FIG. 13, the mounting board 65 is formed as a substantially D-shaped member, defining a truncated circular periphery portion 76 and a straight periphery portion 78. Dedicated conductive traces 67 extend from the pin apertures 74 to corresponding connector pads 69.

Figure 14:
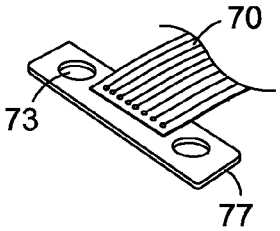
FIG. 14 illustrates a portion of the flexible cable shown at FIG. 11, including the insulating strip.

As shown in FIGS. 12 and 14, the flexible cable 70 terminates in an insulating strip 77, which supports a plurality of exposed conductor pads 75. The insulating strip 77 further incorporates a pair of apertures 73, disposed in vertical registration with mounting board apertures 71, such that flexible cable connector pads 75 may be oriented in vertical registry with mounting board conductor pads 69.

Figure 15:
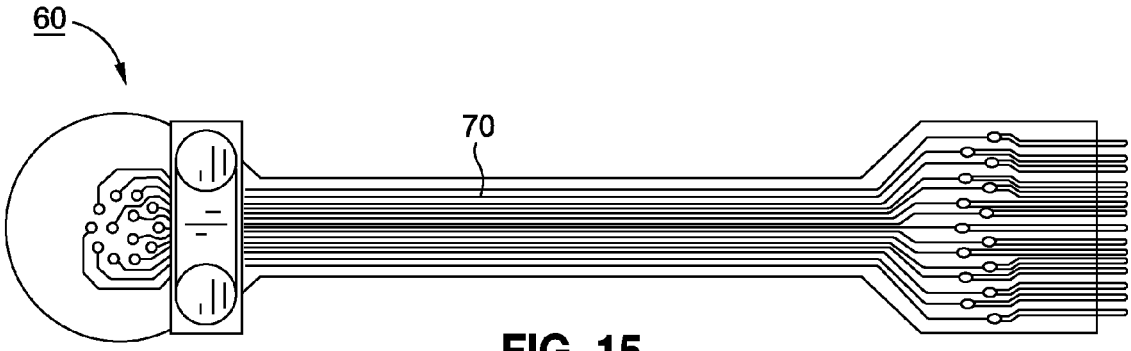
FIG. 15 is a top view of the connector assembly and flexible cable shown at FIG. 11.
Figure 16:
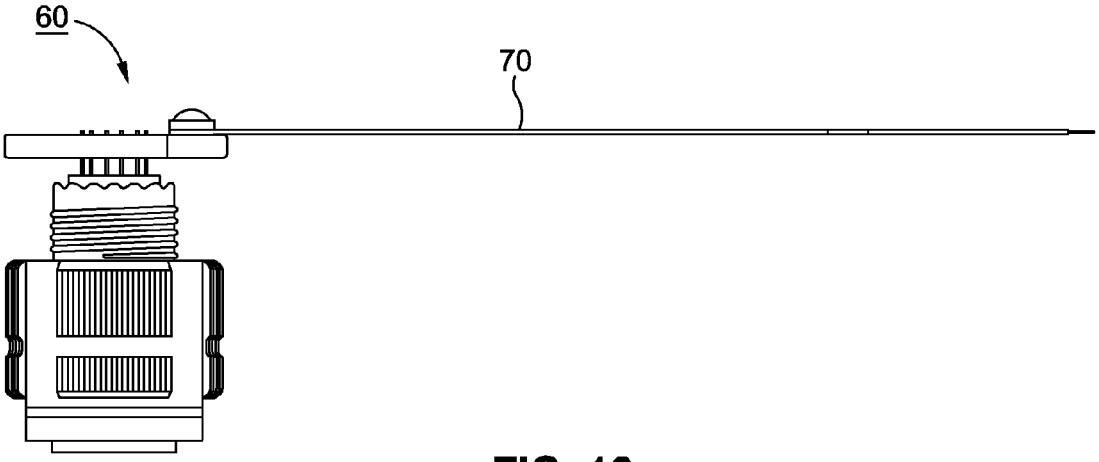
FIG. 16 is a side view of the connector assembly and flexible cable shown at FIG. 11.
Figure 17:
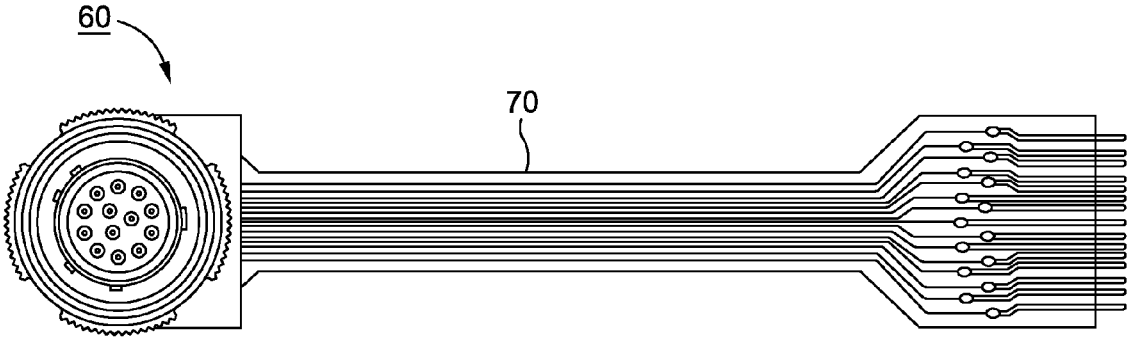
FIG. 17 is a bottom view of the connector assembly and flexible cable shown at FIG. 11.

Retaining member 83 urges resilient member 79 to compress the flexible cable connector pads 75 into electrical communication with the mounting board connector pads 69, when locking pins 85 are extended through apertures 71, 73, 81 and 84. Additional views of the assembly 60, engaged to flexible cable 70 are shown at FIGS. 15, 16 and 17.

Figure 18:
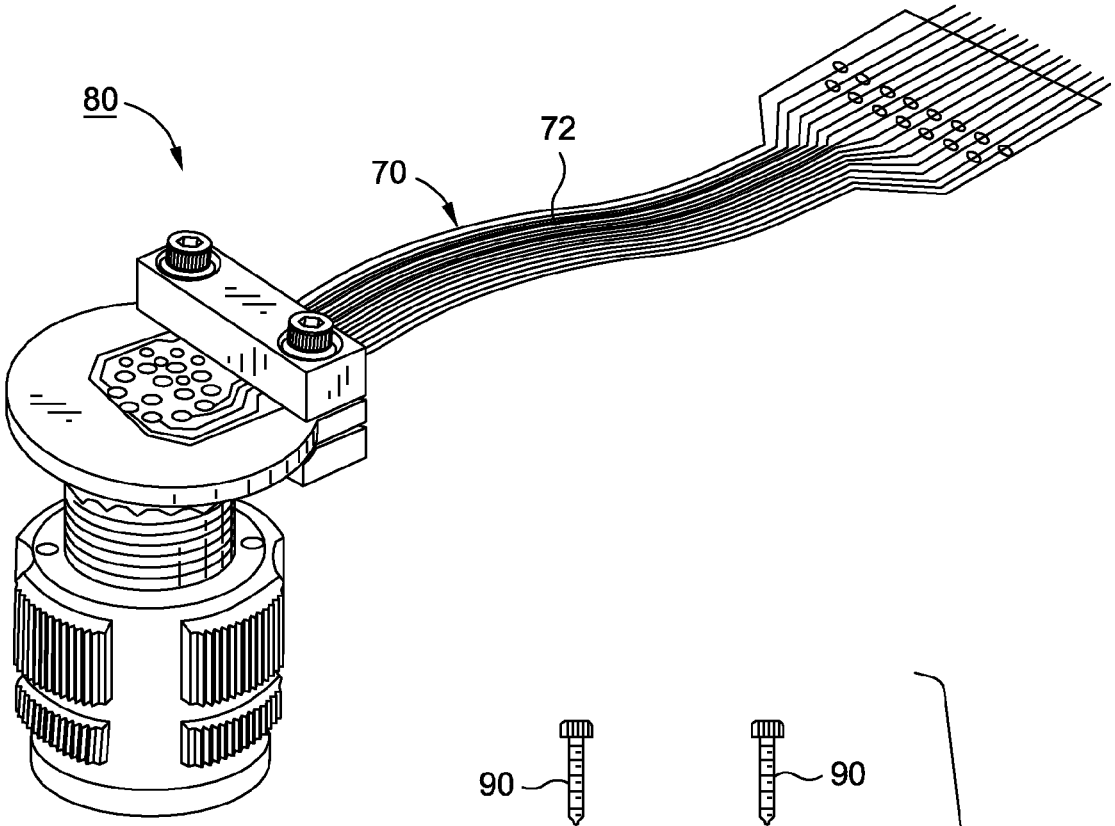
FIG. 18 illustrates another alternate embodiment of a connector assembly in accordance with the present invention, engaged to a flexible cable.
Figure 19:
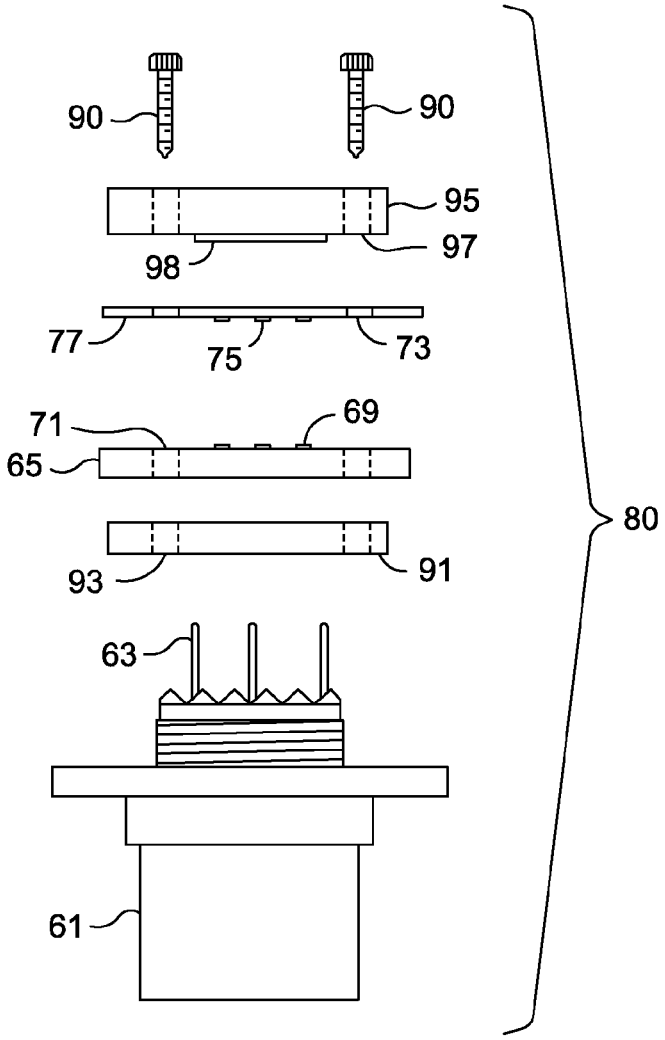
FIG. 19 is an exploded view of the connector assembly shown at FIG. 18.
Figure 20:
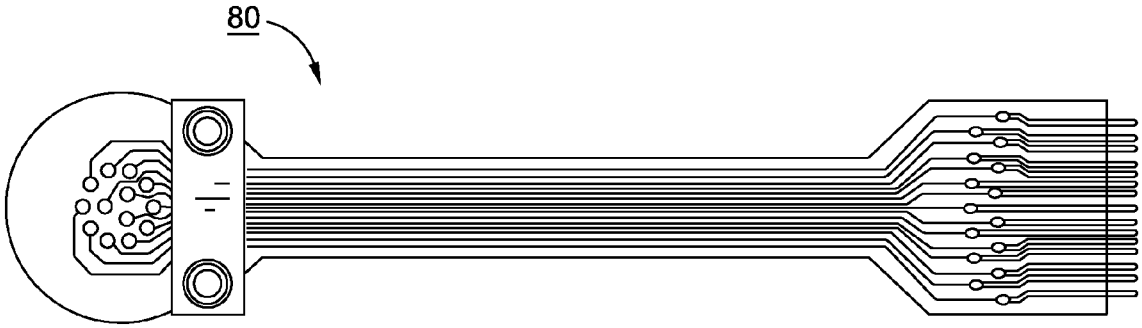
FIG. 20 is a top view of the connector assembly and flexible cable shown at FIG. 18.
Figure 21:
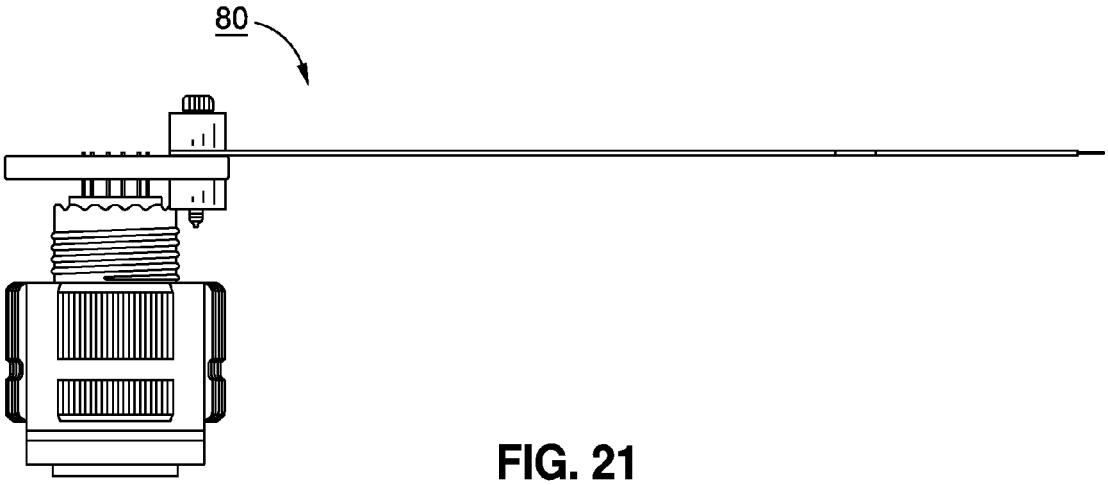
FIG. 21 is a side view of the connector assembly and flexible cable shown at FIG. 18.
Figure 22:
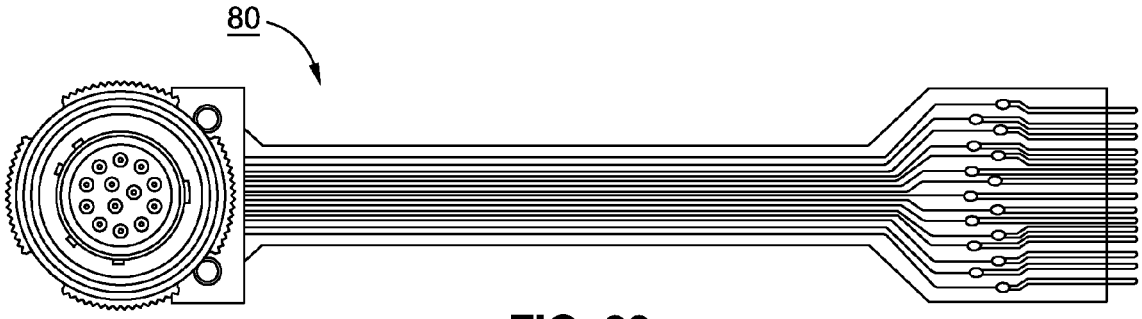
FIG. 22 is a bottom view of the connector assembly and flexible cable shown at FIG. 18.

FIG. 18 illustrates another embodiment of the connector assembly in accordance with the present invention. The illustrated embodiment is similar to that illustrated at FIG. 11-17, except that the retaining member for urging the flexible cable connector pads into electrical communication with the mounting board connector pads is implemented as a pair of retaining bars 91, 95 secured by fasteners 99 extending through apertures 71, 73, 93, and 95. In the illustrated embodiment, retaining bars 91, 95 define a length substantially equal to the diameter of the mounting bar truncated circular portion 78. Further, retaining bar 95 is provided with resilient member 98, extending therefrom, for resiliently urging the flexible cable connector pads 75 into electrical communication with the mounting board connector pads 69. Resilient member 98, similar to resilient members 49, 79, maintains the connector pads 69, 75 in compressive electrical engagement, without damaging the connector pads, notwithstanding vibrations and other environmental stresses. FIGS. 20, 21 and 22 provide additional views of the connector assembly 80 shown at FIGS. 18, 19.

As will be apparent from the above disclosure, the methodology for forming a connector assembly in accordance with the present invention typically proceeds as follows. A mounting board is perforated with an aperture pattern that conforms to the pin pattern of a pin connector. The apertures may be metalized to form conductive vias, which may extend to the upper surface of the mounting board. Alternatively, the apertures need not be metalized. In either case, the apertures are of such a size to closely conform to the pin diameters in order to retain the pins in place within the apertures. The pins are inserted into or through the mounting board sufficient to support and align the pins, while securing the retaining board in place. The mounting board is typically spaced from the connector body, and the length of the pins extending beyond the mounting board may be cut off, or otherwise removed.

A pattern of conductive traces are formed on the upper surface of the mounting board, extending from the pins to conductive pads formed along a periphery portion of the mounting board. The conductive traces may extend to and be in electrical communication with the pins and/or the conductive vias extending from the mounting board apertures.

A flexible cable is formed to include a pattern of exposed conductive pads on the first end of the cable, with each conductive pad being in electrical communication with a conductor extending through the flexible cable. One or both of the mounting board pads and the flexible cable pads may include raised surface areas, which, as previously noted, may be formed for complementary engagement, as described in U.S. Pat. No. 5,691,509 to Balzano or U.S. Pat. No. 6,739,878 to Balzano. However, it is to be understood that in some embodiments of the present invention the mounting board pads and the flexible cable pads may be formed to be substantially flush with the supporting surface, provided that the pads may be urged to into reliable electrical communication, as further described herein.

The flexible cable will preferably include an insulating member, typically formed as a ring or a strip, extending from the cable, which supports the exposed cable connector pads and extends about or across some portion of the mounting board. Apertures or pins may be formed in or mounted on the mounting board, with corresponding apertures formed in the insulating member. The alignment of the apertures will result in orienting the mounting board connector pads and flexible cable connector pads in vertical registry. A resilient member may then be placed above the flexible cable pads and/or below the mounting board and a retaining member may be disposed adjacent the resilient member. The retaining member and the resilient member may be provided with apertures, formed in registry with the mounting board apertures. A screw or pins may be extended through the apertures to resiliently compress the mounting board pads and the flexible cable pads into contact to ensure electrical communication therebetween. In one embodiment, the retaining member may be formed as a pair of bars, with one bar placed on the upper surface of the resilient member and the second bar placed below the mounting board. The bars may be formed to include apertures to allow screws to extend therethrough, compressing the intermediate mounting board connector pads and flexible cable connector pads into reliable electrical communication.

The above description is given by way of example, and not limitation. Given the above disclosure, one skilled in the art could devise variations in various of the disclosed features, such as the arrangement of the mounting board, the construction of the retaining member or the type of connecting cable used. Such variations are understood to be within the scope and spirit of the invention disclosed herein.

What is claimed is:

1. A connector assembly for communicating electrical signals between a connector having a plurality of pins and a remote location, the assembly comprising:

a mounting board mountable on the pins, the mounting board having a plurality of apertures for receiving and retaining the pins, the mounting board further having a plurality of conductive patterns formed thereon, each conductive pattern extending from one of the pin apertures to an associated mounting board connector pad formed on the mounting board;

a flexible cable having a plurality of conductors extending therethrough and a plurality of cable connector pads, in electrical communication with an associated cable conductor, the flexible cable being disposed adjacent the mounting board such that the cable connector pads are arrayed proximate the mounting board connector pads in vertical registry therewith;

a retaining member connected to the mounting board for urging the flexible cable connector pads into electrical communication with the mounting board connector pads;

wherein the mounting board defines a substantially "D" shaped, defining a truncated circular periphery portion and a straight periphery portion, the mounting board connector pads being arrayed alone the straight periphery portion; and wherein the retaining member defines at least one retaining bar engageable to the mounting board, and a resilient member disposed intermediate the retaining bar and the mounting board.

2. The assembly as recited in claim 1 wherein the mounting board connector pads are arrayed along a peripheral portion of the mounting board.

3. The assembly as recited in claim 1 wherein the retaining member resiliently urges the flexible cable connector pads into electrical communication with the mounting board connector pads.

4. The assembly as recited in claim 1 wherein each of the pins is associated with a dedicated conductive pattern on the mounting board.

5. The assembly as recited in claim 4 wherein each of the conductive patterns is associated with a dedicated mounting board connector pad.

6. The assembly as recited in claim 5 wherein each of the mounting board connector pads is in electrical communication with a dedicated flexible cable connector pads.

7. The assembly as recited in claim 6 wherein each of the flexible cable conductors is in electrical communication with an associated cable connector pad.

8. The assembly as recited in claim 7 wherein each of the mounting board connector pads defines a raised contact area.

9. The assembly as recited in claim 8 wherein the mounting board is formed as a substantially "D" shaped disk.

10. The assembly as recited in claim 1 wherein the retaining bar defines a plurality of retaining bar apertures and wherein the flexible cable defines a corresponding plurality of flexible cable apertures disposable in vertical registry with the retaining bar apertures.

11. The assembly as recited in claim 1 wherein the retaining bar defines a length substantially equal to the diameter of the mounting board truncated circular portion.

12. The assembly as recited in the claim 1 wherein each retaining bar defines a plurality of retaining bar apertures, and wherein the flexible cable is formed to define a pair of flexible cable apertures being disposed in vertical registry with the retaining bar apertures.

13. The assembly as recited in claim 12 wherein the mounting board defines a plurality of mounting board apertures formed in the mounting board along the straight periphery portion thereof, the mounting board apertures being disposed in vertical registry with the retaining bar apertures.

14. The assembly as recited in claim 13 wherein the retaining member defines a pair of retaining bars, each retaining bar being disposed on an opposing side of the mounting board, the retaining bars being engageable to each other to urge a flexible cable connector pads into electrical communication with the mounting board connector pads.

* * * * *